US011083931B2

(12) United States Patent
Friedman et al.

(10) Patent No.: US 11,083,931 B2
(45) Date of Patent: Aug. 10, 2021

(54) EXERCISE CYCLE

(71) Applicant: Flint Rehabilitation Devices, LLC, Irvine, CA (US)

(72) Inventors: Nizan Friedman, Irvine, CA (US); Daniel K. Zondervan, Long Beach, CA (US)

(73) Assignee: Flint Rehabilitation Devices, LLC, Irvine, CA (US)

( * ) Notice: Subject to any disclaimer, the term of this patent is extended or adjusted under 35 U.S.C. 154(b) by 55 days.

(21) Appl. No.: 16/373,530

(22) Filed: Apr. 2, 2019

(65) Prior Publication Data

US 2019/0299053 A1 Oct. 3, 2019

Related U.S. Application Data

(60) Provisional application No. 62/651,490, filed on Apr. 2, 2018.

(51) Int. Cl.

| | |
|---|---|
| ***A63B 22/06*** | (2006.01) |
| ***A63B 21/00*** | (2006.01) |
| ***A63B 21/22*** | (2006.01) |
| ***A63B 21/005*** | (2006.01) |

(52) U.S. Cl.

CPC ..... *A63B 22/0605* (2013.01); *A63B 21/0051* (2013.01); *A63B 21/00069* (2013.01); *A63B 21/00192* (2013.01); *A63B 21/152* (2013.01); *A63B 21/225* (2013.01); *A63B 22/0694* (2013.01); *A63B 2220/13* (2013.01); *A63B 2220/833* (2013.01)

(58) Field of Classification Search

CPC ..... A63B 21/00069; A63B 21/152; A63B 21/0051; A63B 21/00192; A63B 21/225; A63B 21/005; A63B 21/0052; A63B 22/0605; A63B 22/0694; A63B 2220/833; A63B 2220/13; A63B 2220/34; A63B 2225/20; A63B 2225/50

See application file for complete search history.

(56) References Cited

U.S. PATENT DOCUMENTS

| | | | | |
|---|---|---|---|---|
| 8,079,273 | B2 * | 12/2011 | Svenberg | A63B 21/015 73/862.08 |
| 9,999,818 | B2 * | 6/2018 | Hawkins, III | A63B 21/00069 |
| 10,369,416 | B2 * | 8/2019 | Huang | A63B 22/0605 |
| 10,391,348 | B2 * | 8/2019 | Gibson | F16D 49/00 |
| 10,537,764 | B2 * | 1/2020 | Smith | A63B 21/00069 |
| 10,639,512 | B2 * | 5/2020 | Huang | A63B 21/0056 |
| 2016/0310785 | A1 * | 10/2016 | Lo | A63B 21/005 |
| 2017/0106222 | A1 * | 4/2017 | Mayer | A63B 22/0605 |
| 2017/0319906 | A1 * | 11/2017 | Chang | G01L 3/22 |
| 2020/0338383 | A1 * | 10/2020 | Liu | A63B 21/0051 |

* cited by examiner

*Primary Examiner* — Megan Anderson
(74) *Attorney, Agent, or Firm* — Thomas|Horstemeyer

(57) ABSTRACT

An exercise cycle includes a crankshaft, cranks mounted to the crankshaft, a drive mechanism including a ferromagnetic flywheel that rotates in response to rotation of the crankshaft, and a non-contact force adjustment mechanism with which a force required to rotate the flywheel can be adjusted, the force adjustment mechanism including a pivotable member to which magnets are mounted, wherein the magnets can be moved closer to the flywheel when the pivotable member is pivoted toward the flywheel to increase the force required to rotate the flywheel and can be moved farther away from the flywheel when the pivotable member is pivoted away from the flywheel to decrease the force required to rotate the flywheel.

12 Claims, 7 Drawing Sheets

EXERCISE CYCLE

CROSS-REFERENCE TO RELATED APPLICATION

This application claims priority to U.S. Provisional Application Ser. No. 62/651,490, filed Apr. 2, 2018, which is hereby incorporated by reference herein in its entirety.

BACKGROUND

With people adopting more sedentary lifestyles with each passing decade, it is more important than ever before to ensure that one exercises on a regular basis. Unfortunately, this can be a challenge when one has a job that requires him or her to sit at a desk for extended periods of time. It would be desirable to have an exercise device that can be used while one works at his or her desk. This way, even though the individual may need to be seated for extended periods of time, he or she can still exercise.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

As described above, it would be desirable to have an exercise device that can be used while one sits at a desk. Disclosed herein are embodiments of such an exercise device. More particularly, disclosed is an exercise cycle that one can use in a seated position and, therefore, while working at a desk. In some embodiments, the amount of effort required to turn a crankshaft of the exercise cycle can be adjusted with a non-contact force adjustment mechanism. In some embodiments, the position of the force adjustment mechanism can be precisely measured using a linear potentiometer. In such cases, the calories burned by the user while operating the exercise cycle can be precisely calculated.

In the following disclosure, various specific embodiments are described. It is to be understood that those embodiments are example implementations of the disclosed inventions and that alternative embodiments are possible. All such embodiments are intended to fall within the scope of this disclosure.

Figure 1:
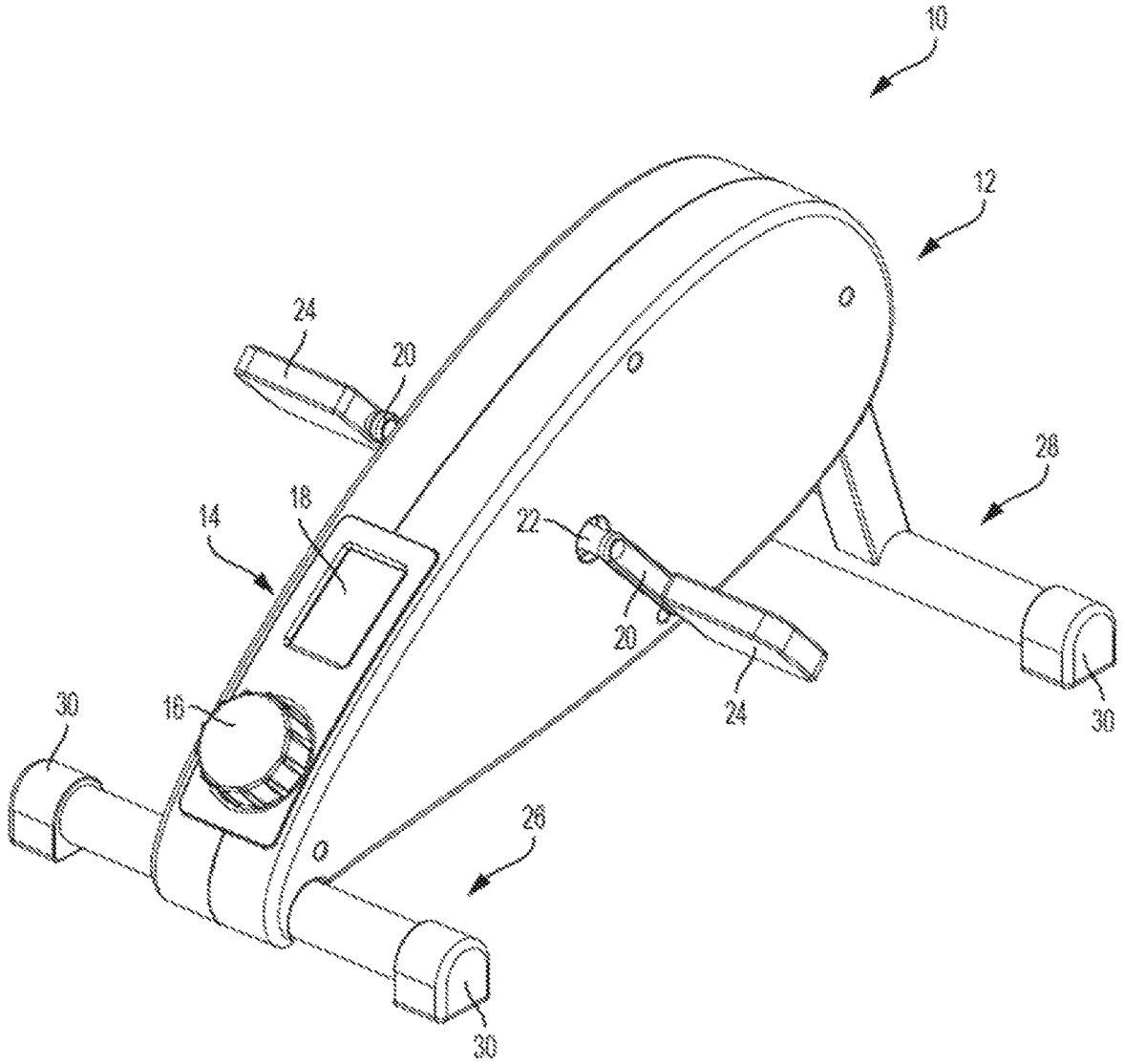
FIG. 1 is a perspective view of an embodiment of an exercise cycle.

FIG. 1 illustrates an embodiment of an exercise cycle 10. As noted above, the exercise cycle 10 is configured to be used while in a seated position and, therefore, can be used while working at a desk. Accordingly, the exercise cycle 10 may be described as a "desk cycle." While this is one application for the exercise cycle 10, it is noted that others are possible. For example, the exercise cycle 10 does not need to be used under a desk. Generally speaking, the exercise cycle 10 can be used in any seated context, such as while watching television or performing another seated activity. In addition, the exercise cycle 10 need not be used for only for exercise. For example, the exercise cycle 10 can be used for physical therapy and rehabilitation. In still other applications, the exercise cycle 10 can be used in a gaming context.

As shown in FIG. 1, the exercise cycle 10 includes an outer housing 12 that contains internal components of the cycle, which are described below. In some embodiments, the outer housing 12 comprises two polymeric halves that are attached together with fasteners, such as screws. Integrated into the outer housing 12 is a control panel 14 that can be used to adjust the force that the user must exert to operate the exercise cycle 10. The control panel 14 includes a force adjustment knob 16 that can be turned clockwise to increase this force, or counterclockwise to decrease the force. Integrated into the control panel 14 is a touch screen 18, such as a touch-sensitive liquid crystal display (LCD), that can be used to receive user commands as well as convey various information to the user, such as a difficulty level (which relates to the selected amount of force), speed, distance traveled, and calories burned. The information displayed in the screen 18 is generated by electronics (not visible in FIG. 1) that are also integrated into the control panel 14. As described below, these electronics can, in some embodiments, comprise a circuit board that integrates a central controller, non-volatile memory, a power source, and a wireless transceiver that can wirelessly communicate information to a suitable computing device, such as a smart phone or computer.

With further reference to FIG. 1, extending from opposed lateral sides of the outer housing 12 are cranks 20 that are fixedly mounted to a shared crankshaft 22. Pivotally mounted to the distal ends of the cranks 20 are foot pedals 24 that can be pressed by the user to rotate the cranks and the crankshaft 22. In some embodiments, foot straps, such as hook-and-loop foot straps, can be provided on the pedals 24 to help maintain the user's feet on the pedals when the exercise cycle 10 is used. Also shown in FIG. 1 are front and rear supports 26 and 28 that are used to support the exercise cycle 10 on a surface, such as the floor. These supports 26, 28 extend laterally outward from the outer housing 12 and are attached to an inner frame of the exercise cycle 10 (not visible in FIG. 1). In addition, they include non-slip feet 30 that are mounted to the opposed ends of the supports 26, 28.

Figure 2:
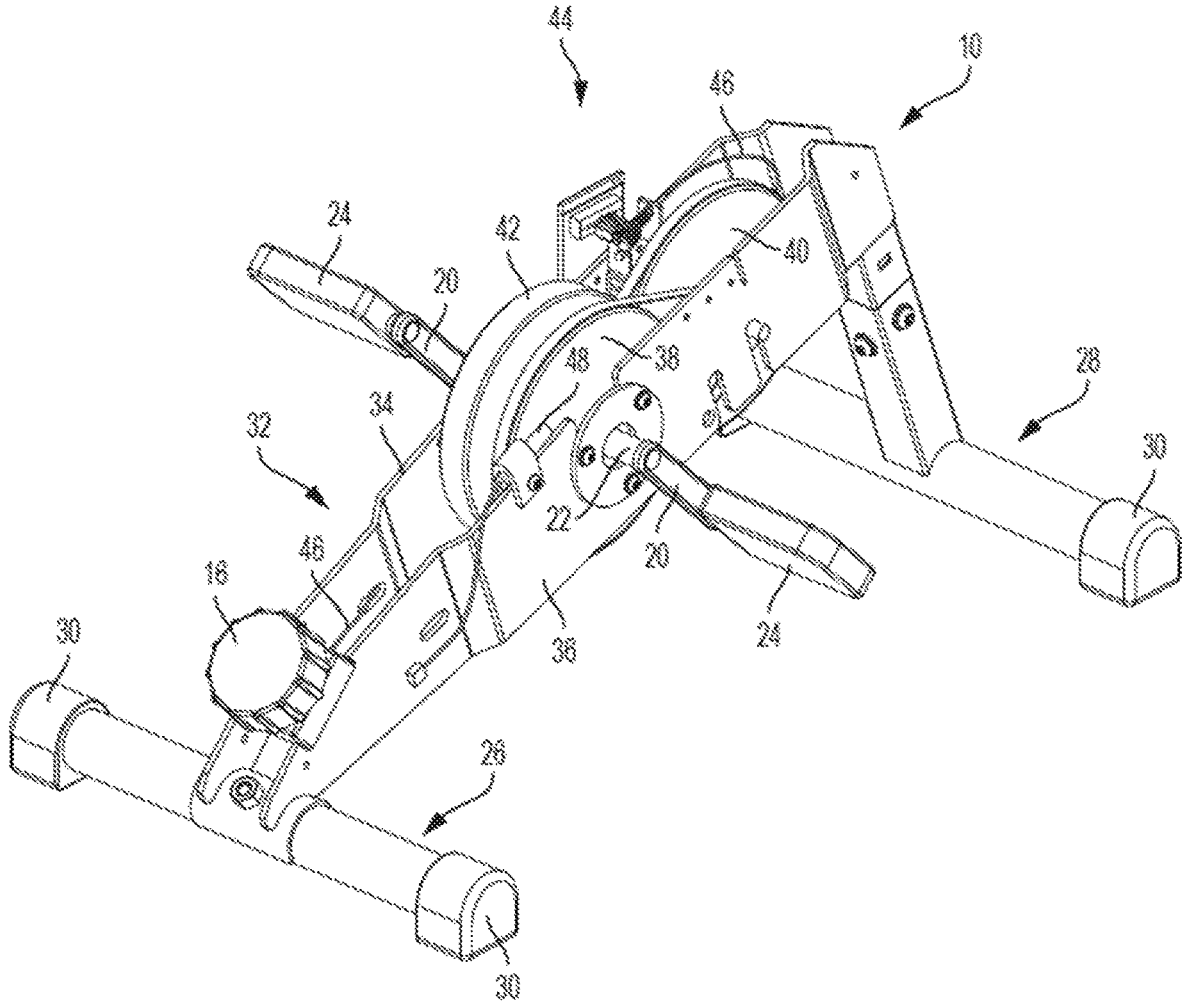
FIG. 2 is a perspective view of the exercise cycle of FIG. 1 with an outer housing of the cycle removed.

FIG. 2 shows the exercise cycle 10 with the outer housing 12 removed. Accordingly, the control panel 14 shown in FIG. 1 has also been removed, although the force adjustment knob 16 remains. Because the outer housing 12 has been removed, the inner frame 32 of the exercise cycle 10 is visible. In the illustrated embodiment, the inner frame 32 includes two frame members, including a leftside frame member 34 and a rightside frame member 36. Each of these frame members 34, 36 can be made of a strong, durable material, such as steel. Also visible in FIG. 2 are the various components that comprise a drive mechanism of the exercise cycle 10. These components include a first pulley 38, a second pulley 40, and a flywheel 42. Further visible in FIG. 2 is part of a non-contact force adjustment mechanism 44 that is controlled with a Bowden cable 46 that extends between the mechanism and the force adjustment knob 16. In addition, a speed sensor 48, such as a reed switch, is visible in the figure. This sensor 48 is used to measure the rotational speed of the first pulley 38.

Figure 3:
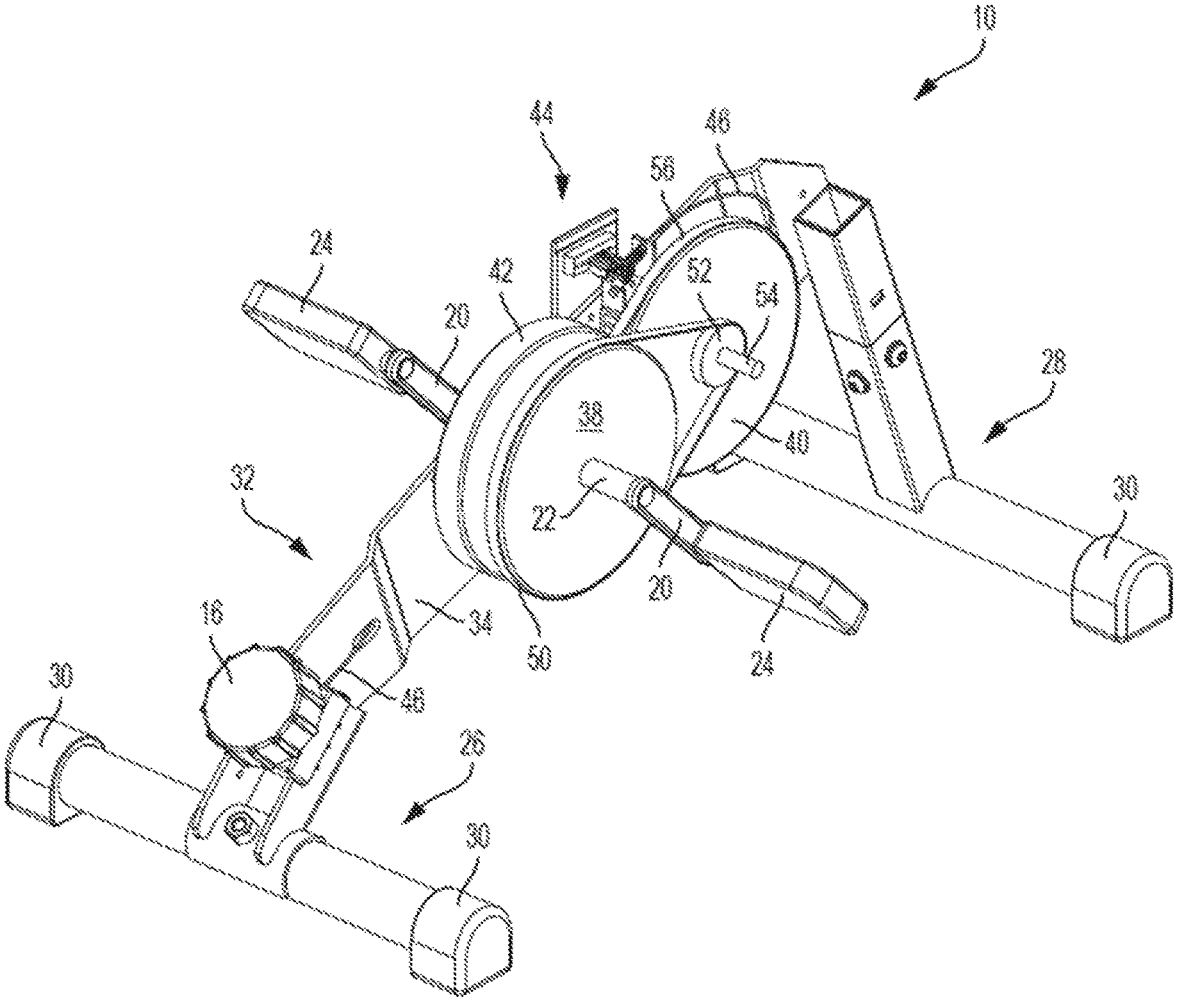
FIG. 3 is a perspective view of the exercise cycle of FIG. 1 with the outer housing and a portion of an inner frame of the cycle removed.

The drive mechanism of the exercise cycle 10 can be seen more clearly in FIG. 3, which illustrates the cycle with not only the outer housing 12 removed, but also the rightside frame member 36 removed. As can be appreciated from FIG. 3, the first pulley 38 is fixedly mounted on the crankshaft 22 so that, when the crankshaft rotates, so does the first pulley. Mounted to the first pulley 38 is a first belt 50 that is also mounted to a hub 52 that is fixedly mounted to the second pulley 40. Accordingly, when the first pulley 38 rotates, the first belt 50 also rotates, which causes rotation of the hub 52 and the second pulley 40. The second pulley 40 is rotatably mounted to an axle 54 about which the second pulley can freely rotate due to the presence of a bearing (not shown).

Figure 4:
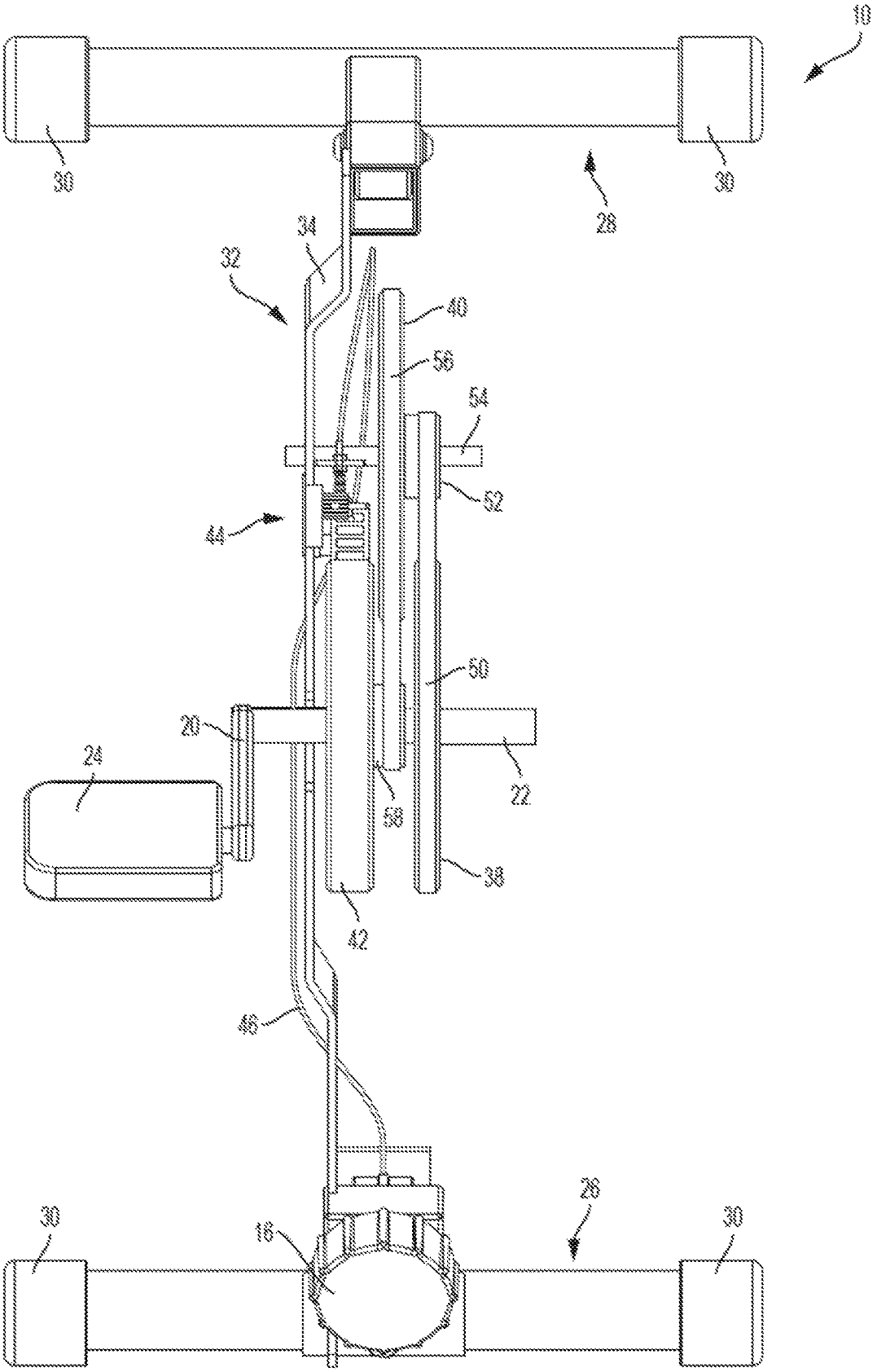
FIG. 4 is a top view of the exercise cycle of FIG. 1 with the outer housing and the portion of the inner frame of the cycle removed.

With reference next to FIG. 4, mounted to the second pulley 40 is a second belt 56 that is also mounted to a hub 58 of the flywheel 42. The hub 58 is fixedly mounted to the flywheel 42, so that rotation of second pulley 40 causes rotation of the second belt 56, which causes rotation of the hub 58, which causes rotation of the flywheel 42. Unlike the first pulley 38, the flywheel 42 is not fixedly mounted to the crankshaft 22. Accordingly, the flywheel 42 is free to rotate independent of the crankshaft 22.

Figure 5:
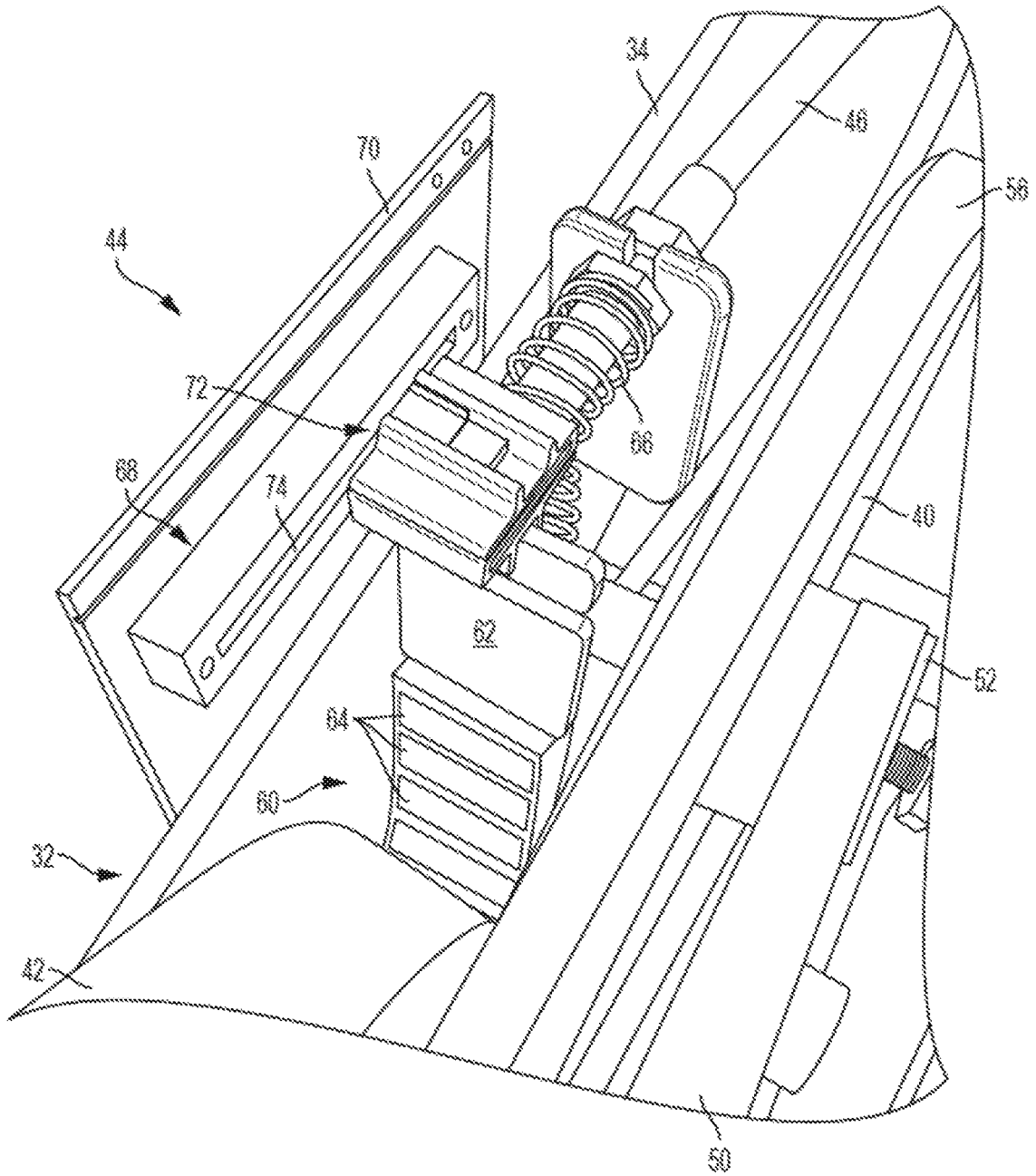
FIG. 5 is a perspective detail view of a portion of an embodiment of a force adjustment mechanism that can be used in the exercise cycle of FIG. 1.
Figure 6:
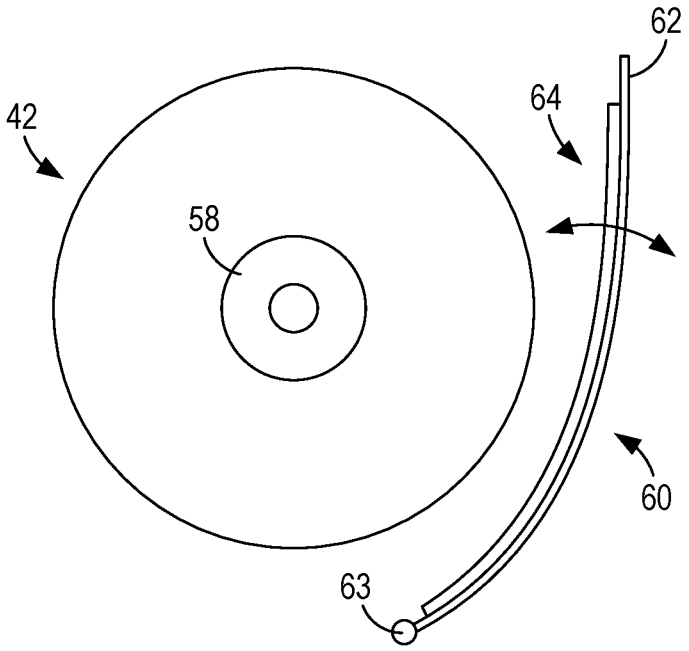
FIG. 6 is a schematic view illustrating how a lever of the force adjustment mechanism shown in FIG. 5 pivots relative to a flywheel of the exercise cycle.

FIG. 5 illustrates features of the force adjustment mechanism 44. Visible in this figure is a magnet member 60 that is used to adjust the force that is required to rotate the flywheel 42 and, therefore, rotate the cranks 20. The flywheel 42 is made of, or at least comprises, a ferromagnetic material, such as steel. The magnet member 60 comprises a lever 62 that is pivotally mounted at its proximal (lower) end to the inner frame 32. As schematically illustrated in FIG. 6, the lever 62 can pivot about a pivot axis 63. With reference back to FIG. 5, mounted to the lever 62 along its length are multiple magnets 64, such as rare-earth magnets. The lever 62, and its magnets 64, can be moved closer to or farther away from the flywheel 42 using the Bowden cable 46. For example, when the force adjustment knob 16 is turned clockwise, an inner cable (not visible) within the Bowden cable 46, whose distal end is attached to the distal end of the lever 62, moves the lever closer toward the flywheel 42 with the assistance of a compression spring 66. When the lever 62 and its magnets 64 are moved closer to the flywheel 42, the force required to rotate the flywheel increases. When the lever 62 and its magnets 64 are moved farther away from the flywheel 42, however, by turning the force adjustment knob 16 counterclockwise, the force required to rotate the flywheel decreases. Accordingly, the force required to rotate the flywheel 42, and the cranks 20, can be adjusted in similar manner to a conventional belt-tensioning mechanism but with no physical contact between the force adjustment mechanism 44 and the flywheel.

In some embodiments, the calories burned by the user in operating the exercise cycle 10 are calculated by the electronics of the cycle. In order to calculate this, the electronics must know the position of the lever 62 relative to the flywheel 42. While this position can be estimated from the angular position of the force adjustment knob 16 (e.g., number of turns), the position can be more accurately determined using a position sensor associated with the force adjustment mechanism 44. As shown most clearly in FIG. 7, this sensor comprises a linear potentiometer 68 that is supported by a mounting late 70 that is, in turn, mounted to the left side frame member 34. As the lever 62 of the force adjustment mechanism 44 is moved closer to or farther away from the flywheel 42, the position of a coupling element 72 mounted to a distal end of the lever changes along a length of the linear potentiometer 68. More particularly, a tang 73 of the linear potentiometer 68 located within a linear slot 74 of the linear potentiometer is associated with the coupling element 72. The tang 73 moves along the length of the slot 74 and its linear position along the slot precisely identifies the proximity of the lever 62 to the flywheel 42.

Figure 7:
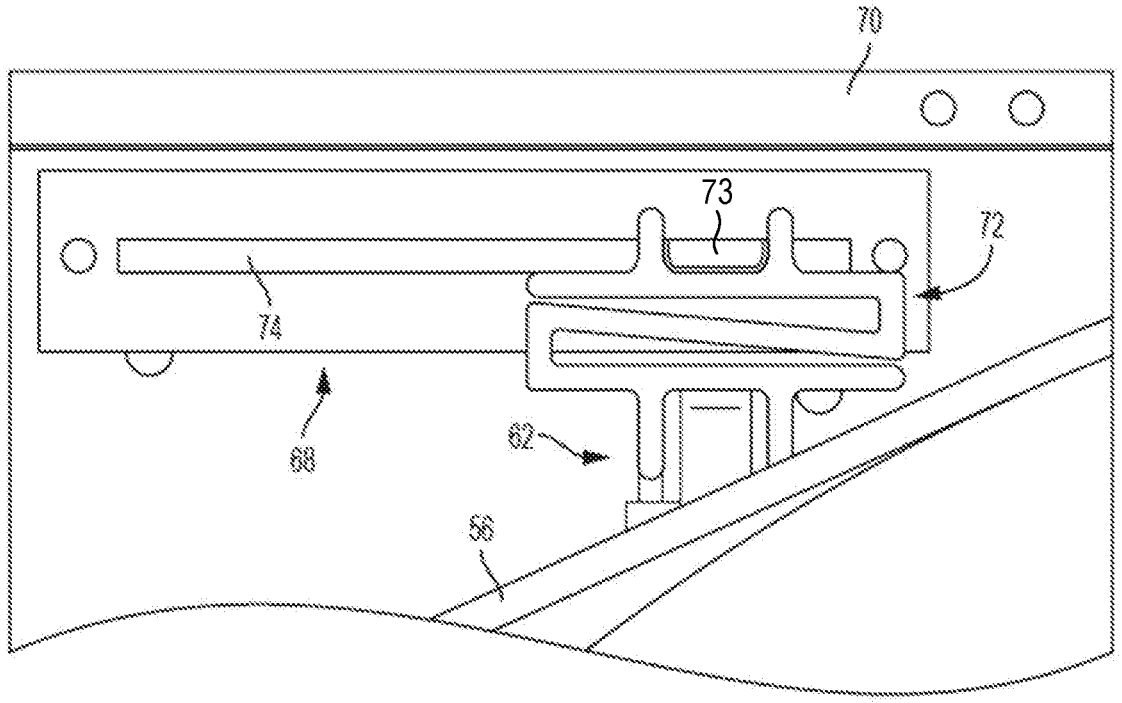
FIG. 7 is a side detail view of an embodiment of a linear potentiometer used to measure the position of the force adjustment mechanism shown in FIG. 5.

Given that the lever 62 of the force adjustment mechanism 44 pivots about a pivot axis 63 associated with its proximal end, the distal end of the lever travels through an arc instead of a straight line. As the slot 74 of the linear potentiometer is linear and, therefore, not arcuate, the coupling element 72 is designed to convert the arcuate motion of the distal end of the lever 62 into a linear motion suitable for the slot. In the embodiment of FIG. 7, the coupling element 72 is configured to flex and twist to enable such motion conversion. In particular, the coupling element 72 comprises a thin Z-shaped element made of a flexible material, such as a polymeric material, such that it is designed to flex and twist to translate the arcuate motion of the distal end of the lever 62 into linear motion that will not cause the tang 73 to bind along the slot 74 of the linear potentiometer 68.

During operation of the exercise cycle 10, a user can turn the cranks 20 of the cycle using the foot pedals 24. As the cranks 20 are turned, the crankshaft 22 is also turned, which causes each of the first pulley 38, second pulley 40, and flywheel 42 to rotate. Rotation of the flywheel 42 is resisted by the magnetic force the magnets 64 of the magnet member 60 to provide resistance that increases the amount of effort that is required by the user to turn the cranks 20. As noted above, this resistance can be increased or decreased as desired by rotating the force adjustment knob 16, this rotation causing the magnets 64 to be moved closer to or farther away from the ferromagnetic flywheel 42. As the user cycles, the distance traveled is calculated by the cycle's electronics with reference to the speed sensor 48. In addition, the calories burned by the user are calculated by the electronics with reference to the position of the lever 62. Because the actual position of the lever 62 is measured using the linear potentiometer 68 instead of estimating this position based upon the angular position of the force adjustment knob 16, a more accurate estimate of the calories burned can be obtained.

Figure 8:
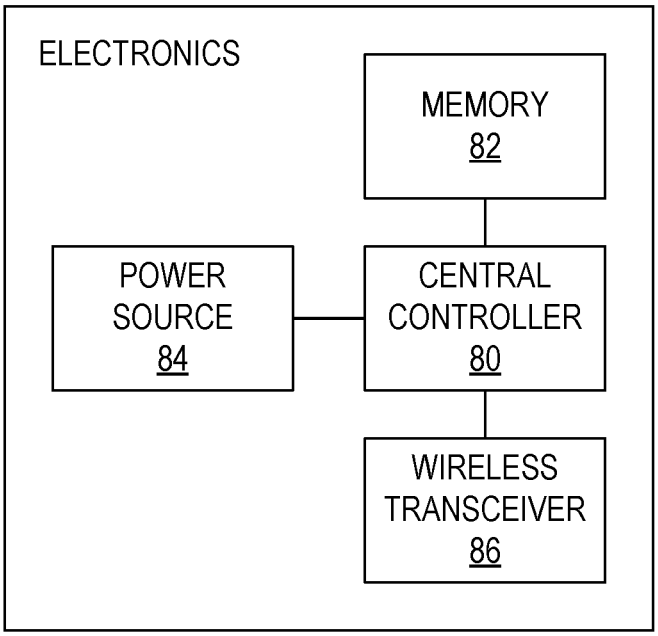
FIG. 8 is block diagram of an embodiment of electronics of the exercise cycle of FIG. 1.

FIG. 8 is a block diagram of an embodiment of electronics of the exercise cycle 10. As shown in FIG. 8, the electronics include a central controller 80 (e.g., in the form of a microchip), non-volatile memory 82 (e.g., Flash memory), a power source 84 (e.g., battery), and a wireless (e.g., Bluetooth or WiFi) transceiver 86. Stored in memory 82, which can be integrated into the central controller 80, is a control program 88 that includes one or more algorithms (logic) configured to calculate parameters such as difficulty level, speed, distance traveled, and calories burned. It is noted that, in some embodiments, data can be wirelessly transmitted to an application on the user's smartphone and/or computer that enables the user to track his or her progress, interact and compete with others online, and the like.

The invention claimed is:

1. An assembly comprising:

a non-contact force adjustment mechanism with which a force required to rotate a flywheel is adjusted, the non-contact force adjustment mechanism including a pivotable member to which magnets are mounted, wherein the magnets are moved closer to the flywheel when the pivotable member is pivoted toward the flywheel to increase a force required to rotate the flywheel and are moved farther away from the flywheel when the pivotable member is pivoted away from the flywheel to decrease the force required to rotate the flywheel;

a position sensor associated with the non-contact force adjustment mechanism, the position sensor including a linear potentiometer and being configured to measure a position of the pivotable member and, therefore, the position of the magnets relative to the flywheel; and a coupling element that couples the pivotable member to the linear potentiometer, the coupling element being configured to translate arcuate motion of the distal end of the pivotable member into linear motion along the linear potentiometer.

2. The assembly of claim 1, wherein the coupling element comprises a tang that extends into a linear slot of the linear potentiometer.

3. The assembly of claim 2, wherein the coupling element is flexible so as to be deformable.

4. The assembly of claim 3, wherein the coupling element comprises a Z-shaped element made of a flexible material.

5. The assembly of claim 1, wherein the non-contact force adjustment mechanism includes a force adjustment knob and a cable that connects the force adjustment knob to the pivotable member, wherein rotation of the force adjustment knob causes the pivotable member to move closer to or farther way from the flywheel.

6. The assembly of claim 5, wherein the cable comprises a Bowden cable.

7. The assembly of claim 1, further comprising a drive mechanism and wherein the drive mechanism includes the flywheel.

8. The assembly of claim 7, wherein the flywheel is a ferromagnetic flywheel.

9. The assembly of claim 7, wherein the drive mechanism further includes a first pulley that is fixedly mounted to a crankshaft, a second pulley that is coupled to the first pulley with a first belt, and a second belt that couples the second pulley to the flywheel.

10. The assembly of claim 7, wherein the flywheel rotates in response to rotation of a crankshaft of an exercise cycle.

11. The assembly of claim 1, wherein the magnets comprise rare-earth magnets.

12. A method for measuring a position of a non-contact force adjustment mechanism, the method comprising:

measuring a position of a distal end of a pivotable member of the non-contact force adjustment mechanism with a linear potentiometer, the pivotable member comprising magnets configured to increase a force with which a flywheel is rotated; and translating arcuate motion of the distal end of the pivotable member into linear motion suitable for the linear potentiometer with a flexible coupling element that connects the distal end of the pivotable member to the linear potentiometer.

* * * * *